US007523737B2

(12) United States Patent
Deguchi et al.

(10) Patent No.: US 7,523,737 B2
(45) Date of Patent: Apr. 28, 2009

(54) DRIVE MODE SWITCHING DEVICE FOR MOTORCYCLE

(75) Inventors: Hiromi Deguchi, Shizuoka (JP); Takayuki Toda, Shizuoka (JP); Hideaki Watanabe, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 11/940,700

(22) Filed: Nov. 15, 2007

(65) Prior Publication Data

US 2008/0115761 A1 May 22, 2008

(30) Foreign Application Priority Data

Nov. 17, 2006 (JP) ..... 2006-311074

(51) Int. Cl.
*F02P 5/145* (2006.01)
*F02P 9/00* (2006.01)
*F02D 9/10* (2006.01)
*F02D 11/10* (2006.01)

(52) U.S. Cl. ..... 123/336; 123/406.45; 123/406.52; 123/683

(58) Field of Classification Search ..... 123/336, 123/406.45, 406.52, 683
See application file for complete search history.

(56) References Cited

U.S. PATENT DOCUMENTS 4,294,205 A * 10/1981 Iiyama et al. ..... 123/274
4,962,570 A * 10/1990 Hosaka et al. ..... 123/399
5,076,385 A * 12/1991 Terazawa et al. ..... 180/197
5,261,382 A * 11/1993 Nikolai ..... 123/680
5,553,590 A * 9/1996 Suzuki et al. ..... 123/308
5,845,677 A * 12/1998 Kim ..... 137/595
5,860,405 A * 1/1999 Muramatsu et al. ..... 477/111
6,047,680 A * 4/2000 Shimura et al. ..... 123/399
6,581,567 B2 * 6/2003 Deguchi ..... 123/336
2004/0154590 A1 * 8/2004 Yasui et al. ..... 123/399

FOREIGN PATENT DOCUMENTS

JP 2001-263186 9/2001
JP 2005-2735743 10/2005

OTHER PUBLICATIONS

English language Abstract of JP 2001-263186.
English language Abstract of JP 2005-273574.

* cited by examiner

*Primary Examiner*—Erick Solis
(74) *Attorney, Agent, or Firm*—Greenblum & Bernstein, P.L.C.

(57) ABSTRACT

A motorcycle includes a throttle, a main throttle valve controlled to be opened or closed by an operation of the throttle and a sub throttle valve controlled to be opened or closed in response to an opening degree of the main throttle valve. A memory a plurality of sub-throttle valve opening degree maps, each of which has unique sub throttle valve opening degree characteristics, fuel injection amount maps each of which has unique fuel injection amount characteristics and corresponds to each of the sub throttle valve opening degree maps respectively, and ignition timing maps, each of which has unique ignition timing characteristics and corresponds to each of the sub throttle valve opening degree maps respectively. A drive mode selecting switch is operable to select an intended drive mode from a plurality of drive modes so as to select a sub throttle valve opening degree map from the stored sub throttle valve opening degree maps. An engine control unit is operable to control an engine based on the selected sub throttle valve opening degree map, one of the stored fuel injection amount maps and one of the stored ignition timing maps which correspond to the selected sub throttle valve opening degree map.

6 Claims, 5 Drawing Sheets

DRIVE MODE SWITCHING DEVICE FOR MOTORCYCLE

The disclosure of Japanese Patent Application No. 2006-311074 filed on Nov. 17, 2006 including specification, drawings and claims is incorporated herein by reference in its entirety.

BACKGROUND

The present invention relates to a drive mode switching device for a motorcycle having a sub throttle valve in addition to a main throttle valve.

In the past, in a motorcycle that requires high-power engine characteristics, an amount of air intake for a high-rpm and high-power engine was ensured, for example, by enlarging a bore diameter of a throttle body. However, in a low-rpm area of an engine, a throttle valve may not be fully opened to a necessary degree to ensure a power or a situation that a sufficient flow rate of air intake may not be ensured when the throttle valve is too much opened. For this reason, in order to prevent the above-described problems, a related-art motorcycle has a sub throttle valve that is opened or closed by an electric actuator as well as a main throttle valve that is driven by a throttle wire (for example, see Patent Documents 1 and 2).

In such a related-art motorcycle, a motion of a throttle grip that is operated by a rider is transmitted to a driving unit of the main throttle valve via the throttle wire, and then the main throttle valve is opened or closed depending on the motion of the throttle grip. Additionally, a driving force of an actuator using a stepping motor or the like is transmitted to a driving unit of the sub throttle valve and an opening degree of the sub throttle valve is configured to be set on the basis of an opening degree of the main throttle valve. In a low-rpm area in which a flow rate of air intake is slow, even when the main throttle valve is fully opened, a sufficient flow rate of air intake is ensured by closing the sub throttle valve. On the other hand, in a high-rpm area, a power is ensured by controlling the opening degree of the sub throttle valve to be larger than that of the main throttle valve.

Patent Document 1: Japanese Patent Publication No. 2001-263186A

Patent Document 2: Japanese Patent Publication No. 2005-273574A

However, in the related-art motorcycle, since a variation rate of the engine power increases in accordance with an amount of a throttle operation (that is, a variation rate of the opening degree of the throttle valve) that is operated by a rider, the engine rpm considerably varies even when the throttle valve is opened to a low opening degree. As a result, a problem arises in that it is not easy for the rider to operate the throttle valve when driving in rain or on a rough road.

SUMMARY

It is therefore an object of the invention to provide a drive mode switching device for a motorcycle that is designed to improve operability of the throttle valve operated by the rider and safety in driving by adequately controlling a variation in an engine power depending on a variation rate in the main throttle valve generated by the throttle valve operation of the rider.

In order to achieve the above objects, according to an aspect of the invention, there is provided a drive mode switching device for a motorcycle including a throttle, a main throttle valve controlled to be opened or closed by an operation of the throttle and a sub throttle valve controlled to be opened or closed in response to an opening degree of the main throttle valve, the drive mode switching device comprising: a memory storing a plurality of sub-throttle valve opening degree maps, each of which has unique sub throttle valve opening degree characteristics, fuel injection amount maps each of which has unique fuel injection amount characteristics and corresponds to each of the sub throttle valve opening degree maps respectively, and ignition timing maps, each of which has unique ignition timing characteristics and corresponds to each of the sub throttle valve opening degree maps respectively; a drive mode selecting switch operable to select an intended drive mode from a plurality of drive modes so as to select a sub throttle valve opening degree map from the stored sub throttle valve opening degree maps; and an engine control unit operable to control an engine based on the selected sub throttle valve opening degree map, one of the stored fuel injection amount maps and one of the stored ignition timing maps which correspond to the selected sub throttle valve opening degree map.

The stored sub throttle valve opening maps may include maps respectively corresponding to a high power drive mode having an area for opening the sub throttle valve to the maximum opening degree, a low power drive mode for regulating the sub throttle valve to a low opening degree under the operating condition of fully opening the main throttle valve, and an intermediate power drive mode having an intermediate power characteristic between the high power drive mode and the low power drive mode.

Each of the sub throttle valve opening maps may include a three dimensional map depending upon the opening degree of the main throttle valve and a revolution speed of the engine.

A drive mode selectable state where the sub throttle valve opening degree maps are selectable by the drive mode selecting switch may be obtained when the drive mode selecting switch is continuously operated for a predetermined period or more.

When the opening degree of the main throttle valve is less than a predetermined value in the drive mode selectable state, the selecting operation for the drive mode selecting switch may become valid; and when the opening degree of the main throttle valve is more than or equal to the predetermined value in the drive mode selectable state, the selecting operation may become invalid.

The drive mode selectable state may be maintained until an ignition switch is turned off.

According to the invention, it is possible to improve operability and safety in driving by allowing a rider to select an arbitrary sub throttle valve opening degree map depending on various driving conditions such as a road surface condition.

BRIEF DESCRIPTION OF THE DRAWINGS

The above objects and advantages of the present invention will become more apparent by describing in detail preferred exemplary embodiments thereof with reference to the accompanying drawings, wherein:

FIG. 5(*b*) is a view showing a sub-throttle-valve opening degree map at an intermediate power mode in the drive mode switching device; and FIG. 5(*c*) is a view showing a sub-throttle-valve opening degree map at a low power mode in the drive mode switching device.

DETAILED DESCRIPTION OF THE EMBODIMENTS

Hereinafter, an embodiment of the invention will be described with reference to the drawings.

The drive mode switching device for the motorcycle according to the embodiment includes an air-intake device 1 connected to each air-intake port of an engine, an electric control module (ECM) 2 as an engine control unit for controlling the air-intake device 1, and a drive mode selecting switch 3 for selecting a drive mode.

Figure 1:
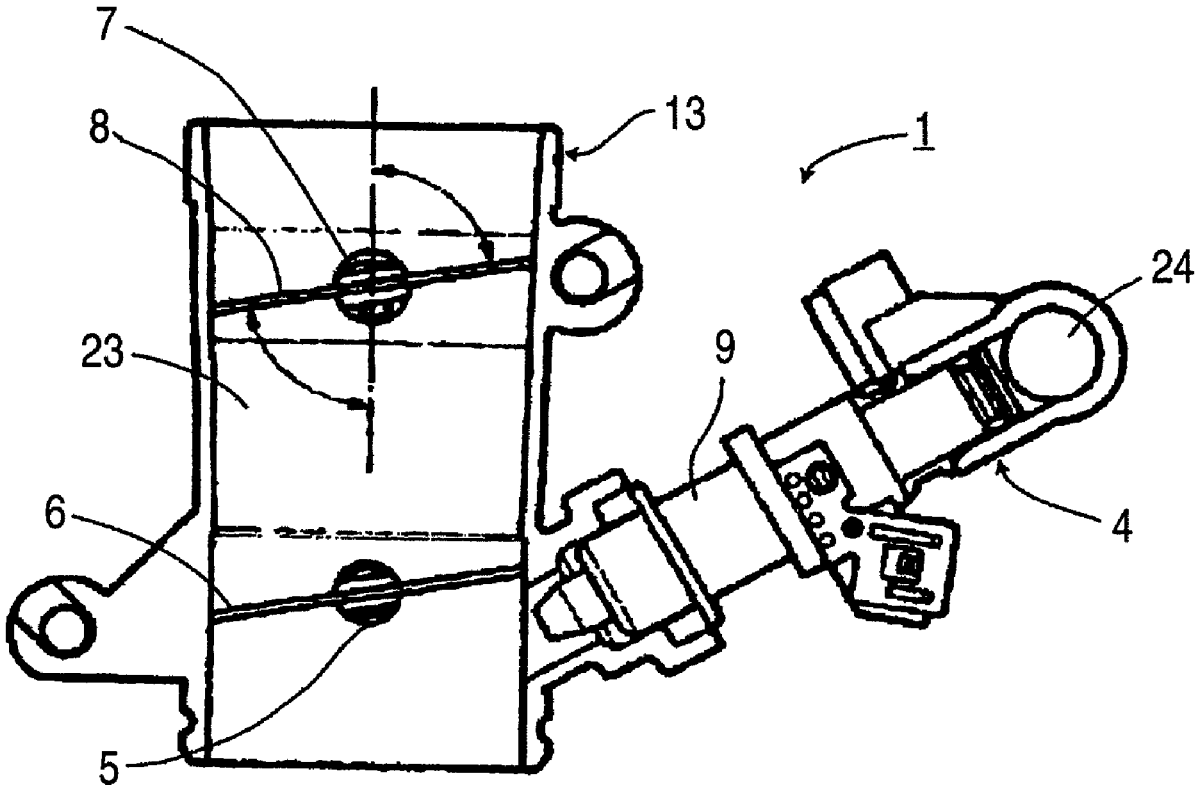
FIG. 1 is a section view showing a throttle valve of a drive mode switching device for a motorcycle according to an embodiment of the invention.

As shown in FIG. 1, the air-intake device 1 includes a throttle passage 23, a throttle body 13 for supplying air to the engine, and a fuel injection unit 4 that is disposed on the outside of the throttle body 13 and that supplies a fuel to the engine.

The throttle body 13 includes a main throttle valve shaft 5 that is rotatably and axially supported by the throttle body 13 so as to traverse the throttle passage 23, a main throttle valve 6 that is fixed to the main throttle valve shaft 5 and that opens or closes the throttle passage 23 by a rotation of the main throttle valve shaft 5, a sub throttle valve shaft 7 that is rotatably and axially supported by the throttle body 13 so as to traverse the throttle passage 23 on the upstream side of the main throttle valve shaft 5, and a sub throttle valve 8 that is fixed to the sub throttle valve shaft 7 and that opens or closes the throttle passage 23 by a rotation of the sub throttle valve shaft 7.

The fuel injection unit 4 includes an injector nozzle 9 that is connected to the throttle body 13 on the downstream side of the main throttle valve 6, and a delivery pipe 24 that is connected to the injector nozzle 9. Accordingly, the fuel is supplied from a fuel tank (not shown) to the injector nozzle 9 via the delivery pipe 24 so as to be injected to the inside of the throttle passage 23.

Figure 2:
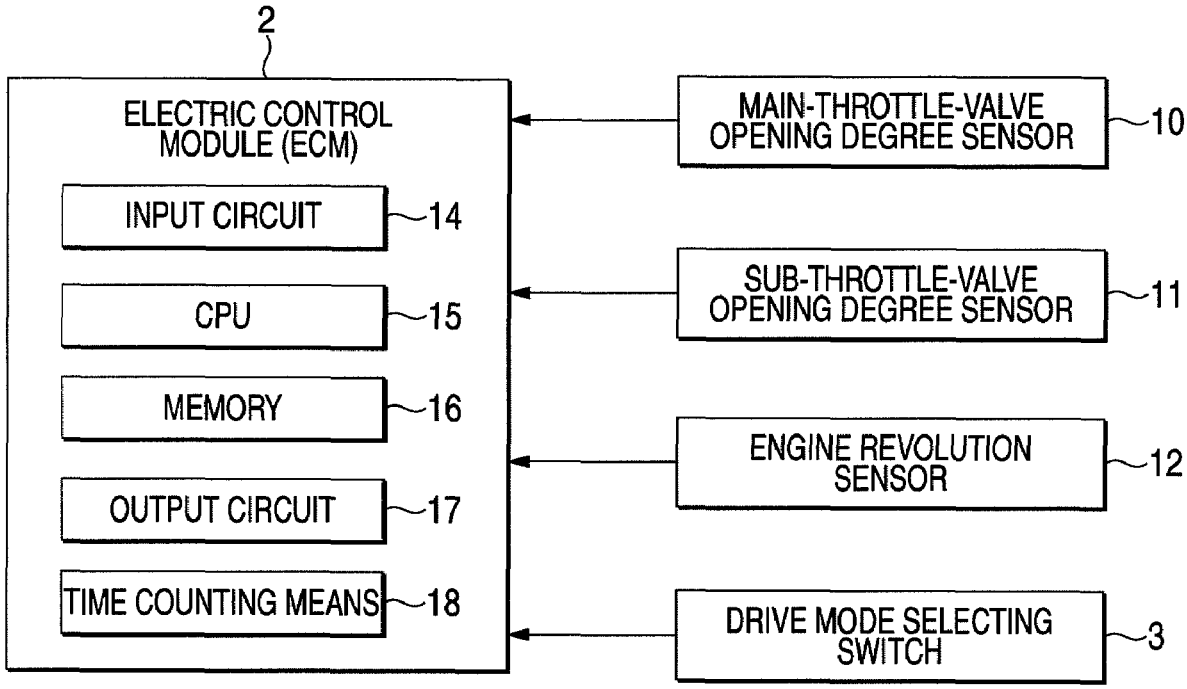
FIG. 2 is a block diagram showing a configuration of an electronic control module of the drive mode switching device according to the embodiment.

As shown in FIG. 2, the electric control module (ECM) 2 includes an input circuit 14 that receives detection signals from various sensors such as a main throttle valve opening degree sensor 10 for detecting an opening degree of the main throttle valve 6, a sub throttle valve opening degree sensor 11 for detecting an opening degree of the sub throttle valve 8, an engine revolution sensor 12, and the drive mode selecting switch 3, a central processing unit (CPU) 15 for performing various control operations, a memory 16 for storing various programs executed in the CPU 15 and various maps described below, or the like, an output circuit 17 for transmitting a driving signal to a motor of the sub throttle valve 8, the fuel injection unit 4, and the like, and time counting means 18 such as a timer for counting a duration.

Figure 3:
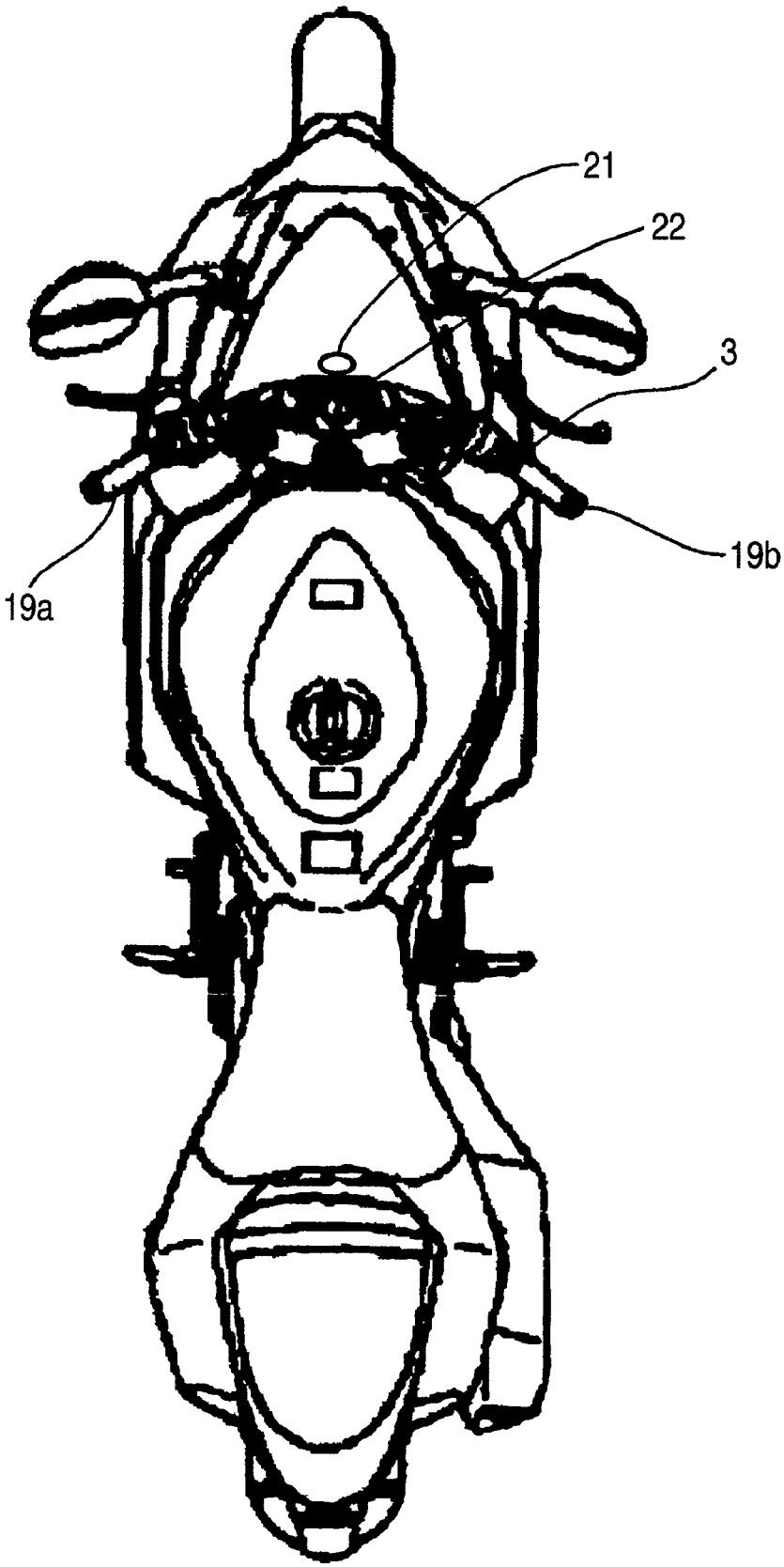
FIG. 3 is a top plan view showing a motorcycle mounted with the drive mode switching device according to the embodiment.
Figure 4:
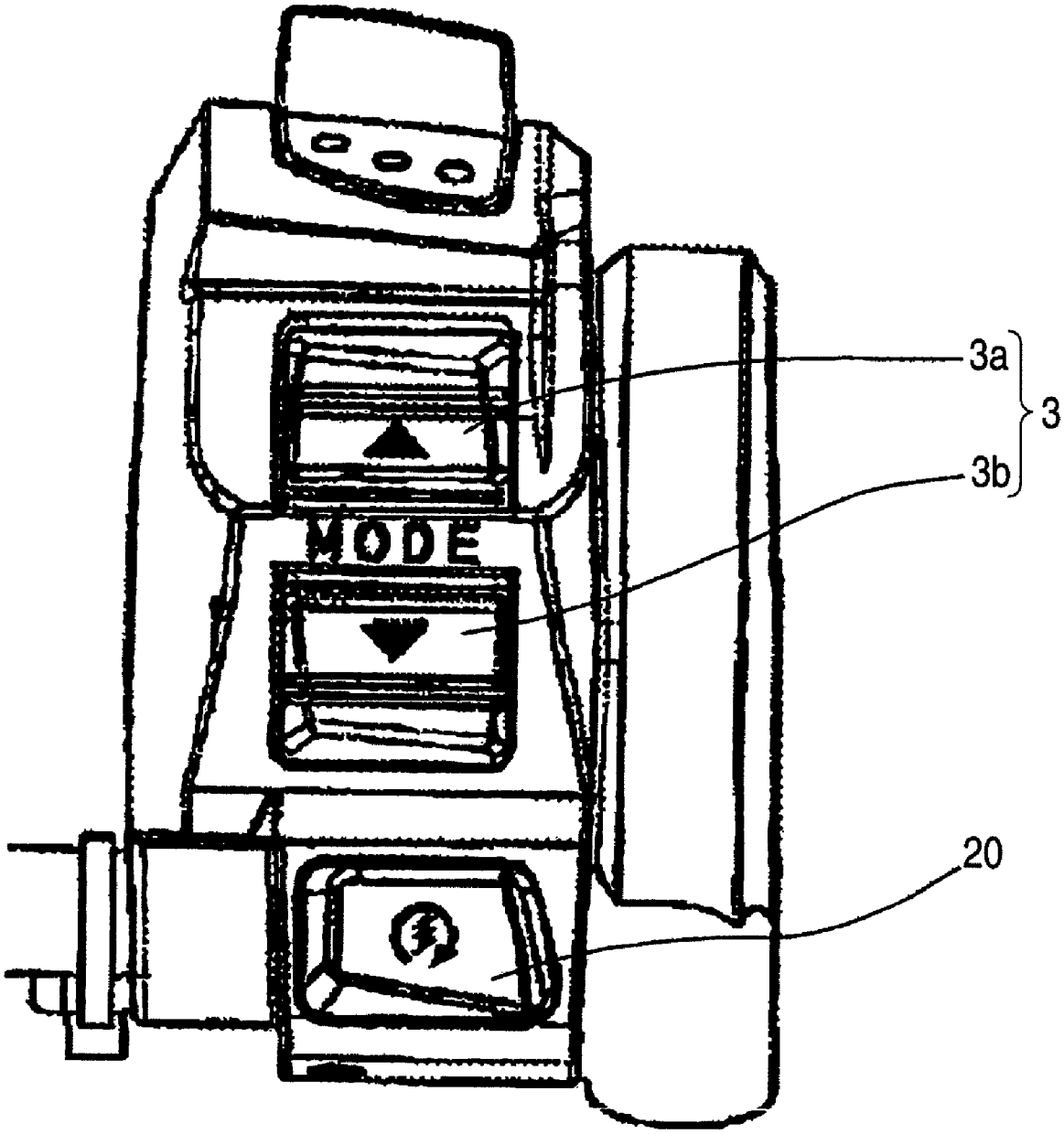
FIG. 4 is a top plan view showing an attachment position of a drive mode switching switch according to the embodiment.

As shown in FIG. 3, the drive mode selecting switch 3 is attached to a right handle grip 19*b* in consideration of convenience of operations instead of a left handle grip 19*a* where operations of a clutch and the like are carried out. In addition, as shown in FIG. 4, the drive mode selecting switch 3 is constituted by drive mode selecting switches 3*a* and 3*b* that are attached to the upper portion of a starting switch 20. For example, when pushing the drive mode selecting switch 3*a* in the upper portion in the case of the drive mode set to three types such as A, B, and C, the drive mode switches in the rotary manner of A, to B, to C, and to A. On the other hand, when pushing the drive mode selecting switch 3*b* in the lower portion, the drive mode switches reversely in the rotary manner of A, to C, to B, and to A.

As shown in FIG. 3, a meter panel 21 and an ignition switch 22 are arranged between the left and right handle grips 19*a* and 19*b*. The drive mode selected by the drive mode selecting switch 3 is displayed on the meter panel 21.

In the embodiment, three-type modes such as a high power mode, a low power mode, and an intermediate power mode having an intermediate power characteristic between the high power mode and the low power mode are selected as drive modes that can be selected by the drive mode selecting switch 3. Three types of sub-throttle-valve opening degree maps corresponding to the respective drive modes, fuel injection amount maps corresponding to the respective sub-throttle-valve opening degree maps and each having a different fuel injection amount characteristics, and ignition timing maps corresponding to the sub-throttle-valve opening degree maps and each having a different ignition timing characteristics are stored in the memory 16.

Figure 5A:
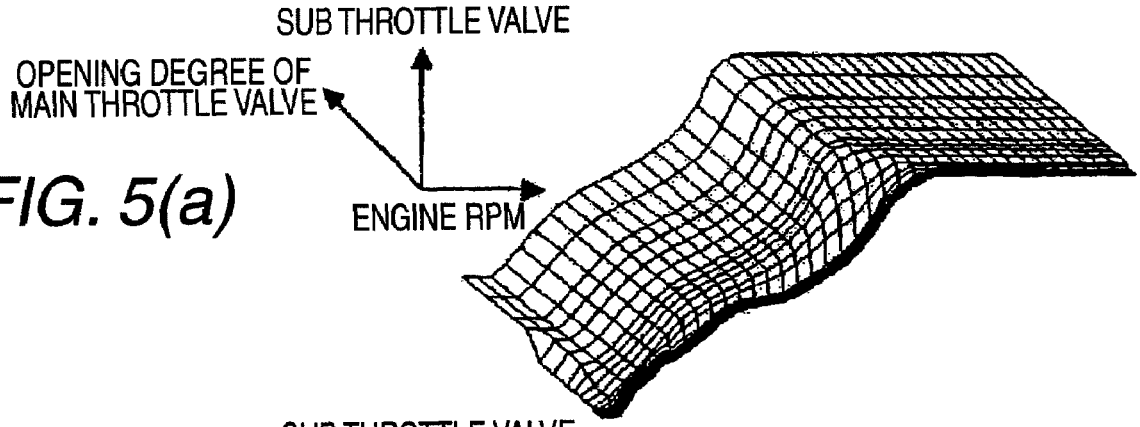
FIG. 5(*a*) is a view showing a sub-throttle-valve opening degree map at a high power mode in the drive mode switching device.
Figure 5B:
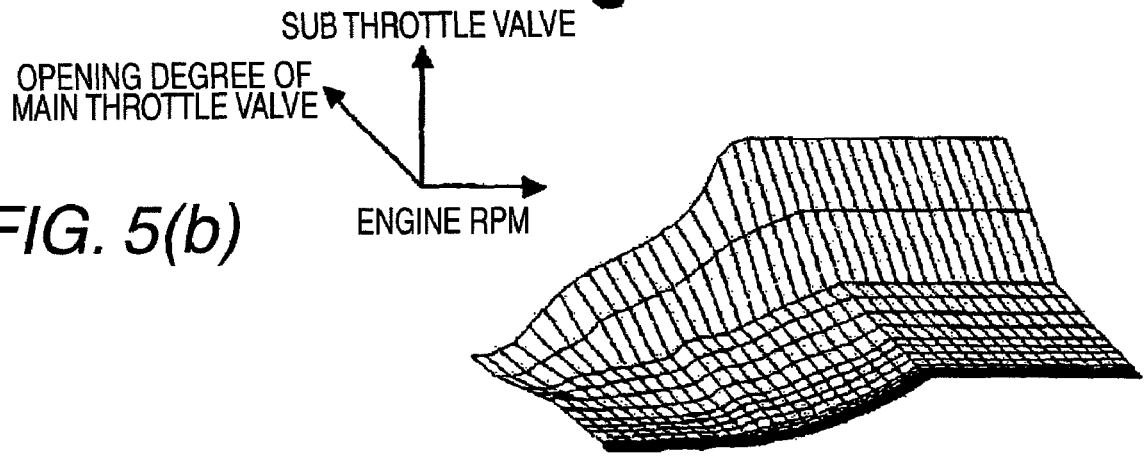
Figure 5C:
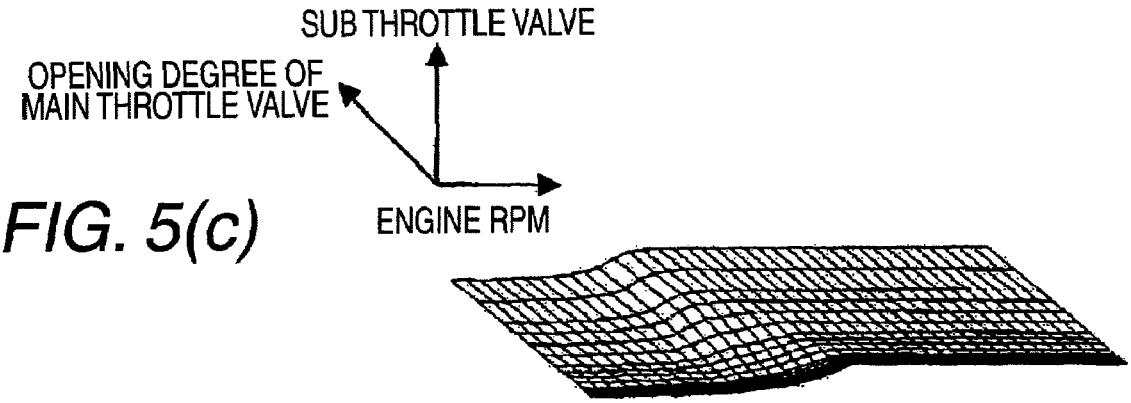

As shown in FIGS. 5(*a*), 5(*b*), and 5(*c*), the three types of sub-throttle-valve opening degree maps are configured as three-dimensional maps depending upon the main throttle valve opening degree and the engine rpm (revolution per minute) as parameters. FIG. 5(*a*) shows the sub-throttle-valve opening degree map corresponding to the high power mode, in which the sub-throttle-valve opening degree map is set so that the sub throttle valve opening degree increases in accordance with an increase of the engine rpm, and the sub throttle valve 8 is configured to be opened almost the maximum opening degree in a whole opening degree area of the main throttle valve 6 and in an area where the engine rpm is high. Further, FIG. 5(*b*) shows the sub-throttle-valve opening degree map corresponding to the intermediate power mode, in which the sub-throttle-valve opening degree map is set so that the sub throttle valve opening degree increases in accordance with an increase of the engine rpm and an increase of the main throttle valve opening degree, and the degree of the engine power is easily adjusted and a high power is possible in accordance with a variation of the opening degree of the main throttle valve 6. Further, FIG. 5(*c*) shows the sub-throttle-valve opening degree map corresponding to the low power mode, in which the sub-throttle-valve opening degree map is set so that the opening degree of the sub throttle valve 6 is regulated to be small even at the time of fully opening the main throttle valve 6 and is particularly suitable in a case where a considerate throttle operation is necessary, for example, when driving the motorcycle in a wet or on a rough road.

In general, since the amount of air intake decreases as much as an engine power is reduced at the time of suppressing the engine power, it is necessary to set the fuel injection amount maps and the ignition timing maps in consideration of both of the opening degree of the main throttle valve and air amount decreasing in accordance with the suppressed engine power in order to obtain an adequate air-fuel ratio. For this reason, in the embodiment, since the fuel injection amount maps and the ignition timing maps are three-dimensional maps depending upon the opening degree of the main throttle valve and the engine rpm as parameters in the same manner as the above-described sub-throttle-valve opening degree maps, arbitrary points on the sub-throttle-valve opening degree maps, the fuel injection amount maps, and the ignition timing maps necessarily correspond to one to one. Accordingly, a particular correction is not necessary, and the fuel injection amount maps and the ignition timing maps are configured to have the same number as that of the sub-throttle-valve opening degree maps at the time of setting the fuel injection amount maps and the ignition timing maps. Therefore, the map setting operation can be simplified.

Next, an operation of the drive mode switching device for the motorcycle according to the embodiment of the invention will be described.

When the rider turns on the ignition switch 22, the drive mode of the motorcycle is set to the high power mode that is set to a predetermined default mode. At this time, the CPU 15 of the electric control module (ECM) 2 controls the opening degree of the sub throttle valve 8 on the basis of the sub-throttle-valve opening degree map corresponding to the high power mode shown in FIG. 5(*a*) and controls the fuel injection amount and the ignition timing on the basis of the fuel injection amount map and the ignition timing map corresponding to the sub-throttle-valve opening degree map for the high power mode. Further, in this state, the drive mode is not displayed on the meter panel 21.

In the low rpm area of the engine rpm of the high power mode, the sub throttle valve 8 is controlled not to be opened more than the opening degree of the main throttle valve even when the main throttle valve 6 is much opened by a rider's throttle operation, so that a sufficient flow rate of the air intake is ensured (or example, the sub throttle valve 8 is maintained in a predetermined opening degree smaller than that of the main throttle valve, etc.). On the other hand, in the area where the power is not reduced even when the main throttle valve 6 is opened, conversely the sub throttle valve is controlled so that the opening degree of the sub throttle valve is maintained to be slightly larger than that of the main throttle valve. Additionally, in the high rpm area of the engine rpm, the sub throttle valve is controlled so that the opening degree of the sub throttle valve is maintained to be slightly larger than that of the main throttle valve, and in an area more than a predetermined engine rpm, the sub throttle valve is controlled to be fully opened regardless of the opening degree of the main throttle valve. Accordingly, the controlling operation of the engine power (amount of air intake) by the throttle operation of the rider is not disturbed by the sub throttle valve 8 in terms of controlling the opening degree of the sub throttle valve on the basis of the opening degree of the main throttle valve and the engine rpm.

Then, when the rider presses the drive mode selecting switch 3*a* or 3*b* for a predetermined period of time or more, the drive mode selectable state where selection operations of the sub-throttle-valve opening degree maps are possible is obtained, and the present drive mode (which is the high power mode in this case) is displayed on the meter panel 21. In this state, it is possible to switch the drive mode whenever the rider presses the drive mode selecting switch 3*a* or 3*b*. That is, when pressing the drive mode selecting switch 3*a* in the upper portion, the drive mode switches in the rotary manner of the high power mode, to the low power mode, to the intermediate power mode, to the high power mode. On the other hand, when pressing the drive mode selecting switch 3*b* in the lower portion, the drive mode switches reversely in the rotary manner of the high power mode, to the intermediate power mode, to the low power mode, and to the high power mode. The CPU 15 of the electric control module (ECM) 2 controls the opening degree of the sub throttle valve 8 on the basis of the sub-throttle-valve opening degree map of the corresponding drive mode, and controls the fuel injection amount and the ignition timing on the basis of the fuel injection amount map and the ignition timing map corresponding to the sub throttle valve opening map of the corresponding drive mode.

However, in this case, the CPU 15 controls the drive mode switching operation to be invalid when the opening degree of the main throttle valve 6 is not less than a predetermined value (for example, 50%) on the basis of the detecting signal from the main throttle valve opening degree sensor 10 to the input circuit 14. Accordingly, it is possible to prevent an abrupt change of power characteristics when the drive mode switching operation is performed at the time of accelerating or driving the motorcycle at high speed while the opening degree is a half or more. Therefore, it is possible to prevent the motorcycle from being slipped at the time of driving in rain.

The drive mode selectable state is maintained until the ignition switch 22 is turned off. Accordingly, it is possible to improve operability of the drive mode switching operation at the time of driving the motorcycle.

As described above, according to the above-described embodiment, since the rider can select an adequate sub-throttle-valve opening degree map depending on various drive conditions such as a road surface condition, it is possible to acquire broad and effective engine performance. Since a control characteristic of the opening degree of the sub throttle valve 8 is switched without changing the fuel injection amount and ignition timing influencing a combustion when engine power characteristics are changed in order to switch the drive mode, a rider's driving feeling may not be affected.

Since each of the fuel injection amount maps and each of the ignition timing maps are switched and controlled in correspondence to each of the sub-throttle-valve opening degree maps, and it is not necessary to correct the fuel injection amount and the ignition timing at the time of switching the sub-throttle-valve opening degree maps, it is possible to shorten a processing time. Since each of the maps is stored in the memory 16 of the electric control module (ECM) 2, it is possible to shorten a searching time of the map. Since a configuration necessary for controlling the engine power is processed by data stored in the electric control module (ECM) 2, other particular components are not necessary except for the sub throttle valve 8, and thus it is possible to simplify the configuration of the apparatus.

Since maps corresponding to the high power mode of full power and the low power mode that is suitable for a slippery road surface in rain or the like are provided, even an inexperienced rider can easily prevent a driving wheel from slipping, and thus it is possible to improve controllability. Since the intermediate power mode is provided, it is possible for the rider to delicately and variously change engine power characteristics.

Since each of the maps is a three-dimensional map depending upon the opening degree of the main throttle valve and the engine rpm as parameters, compared to a two-dimensional map only depending upon the opening degree of the main throttle valve, it is possible to prevent a case where the sub throttle valve is much closed at the time of decelerating in high-speed driving, so that an engine brake is much loaded, and thus it is possible to further improve rider's comfort.

Since the drive mode selectable state is not obtained unless the rider presses the drive mode selecting switch 3*a* or 3*b* for a predetermined period of time or more, it is possible to prevent an erroneous operation, for example, the drive mode switches in an opposite way to a rider's intension.

The above-described drive mode switching operation is just a simple example and can be modified in various forms. For example, when the ignition switch 22 is turned on, the drive mode in last time is maintained and the drive mode is displayed on the meter panel 21. Alternatively, when the ignition switch 22 is again turned on before a predetermined period of time based on the elapsed time from when the ignition switch 22 is turned off, the drive mode in last time is maintained. However, when the ignition switch 22 is again turned on after a predetermined period of time, the default mode can be selected.

In the drive mode selectable state, when the opening degree of the main throttle valve 6 is less than a predetermined value and a vehicle speed is not less than a predetermined value (for example, 30 km/h), the CPU 15 controls the drive mode switching operation to be invalid. Alternatively, in the drive mode selectable state, when the opening degree of the main throttle valve 6 is less than a predetermined value and the engine rpm is not less than a predetermined value (for example, 5,000 rpm), the CPU 15 controls the drive mode switching operation to be invalid. Alternatively, in the drive mode selectable state, when the opening degree of the main throttle valve 6 is less than a predetermined value and after a predetermined period of time from the time when the drive mode selectable state is obtained, the operation of the drive mode selecting switch 3 can be controlled to be invalid.

In the above-described embodiment, the maps are three types, but are just simple examples. The more plurality of types can be employed.

Additionally, when the main throttle valve is an electric control type (fly-by-wire type), the invention can be applied thereto by controlling the opening degree of the main throttle valve instead that of the sub throttle valve.

What is claimed is:

1. A drive mode switching device for a motorcycle including a throttle, a main throttle valve controlled to be opened or closed by an operation of the throttle and a sub throttle valve controlled to be opened or closed in response to an opening degree of the main throttle valve, the drive mode switching device comprising:

a memory storing a plurality of sub-throttle valve opening degree maps, each of which has unique sub throttle valve opening degree characteristics, fuel injection amount maps each of which has unique fuel injection amount characteristics and corresponds to each of the sub throttle valve opening degree maps respectively, and ignition timing maps, each of which has unique ignition timing characteristics and corresponds to each of the sub throttle valve opening degree maps respectively;

a drive mode selecting switch operable to select an intended drive mode from a plurality of drive modes so as to select a sub throttle valve opening degree map from the stored sub throttle valve opening degree maps; and an engine control unit operable to control an engine based on the selected sub throttle valve opening degree map, one of the stored fuel injection amount maps and one of the stored ignition timing maps which correspond to the selected sub throttle valve opening degree map.

2. The drive mode switching device according to claim 1, wherein the stored sub throttle valve opening maps include maps respectively corresponding to a high power drive mode having an area for opening the sub throttle valve to the maximum opening degree, a low power drive mode for regulating the sub throttle valve to a low opening degree under the operating condition of fully opening the main throttle valve, and an intermediate power drive mode having an intermediate power characteristic between the high power drive mode and the low power drive mode.

3. The drive mode switching device according to claim 1, wherein each of the sub throttle valve opening maps includes a three dimensional map depending upon the opening degree of the main throttle valve and a revolution speed of the engine.

4. The drive mode switching device according to claim 1, wherein a drive mode selectable state where the sub throttle valve opening degree maps are selectable by the drive mode selecting switch is obtained when the drive mode selecting switch is continuously operated for a predetermined period or more.

5. The drive mode switching device according to claim 4, wherein:

when the opening degree of the main throttle valve is less than a predetermined value in the drive mode selectable state, the selecting operation for the drive mode selecting switch become valid; and when the opening degree of the main throttle valve is more than or equal to the predetermined value in the drive mode selectable state, the selecting operation become invalid.

6. The drive mode switching device according to claim 4, wherein the drive mode selectable state is maintained until an ignition switch is turned off.

* * * * *